United States Patent [19]

Wiedmer

[11] Patent Number: 4,540,102

[45] Date of Patent: Sep. 10, 1985

[54] RESILIENT MATERIAL SCREW TOP FOR CONTAINERS

[76] Inventor: Walter Wiedmer, Am Linthli 2, Näfels, Switzerland

[21] Appl. No.: 551,363

[22] Filed: Nov. 14, 1983

[30] Foreign Application Priority Data

Nov. 17, 1982 [CH] Switzerland ..... 6709/82

[51] Int. Cl.[3] ..... B65D 53/00

[52] U.S. Cl. ..... 215/344; 215/341; 215/DIG. 1

[58] Field of Search ..... 215/341, 343, 344, 345, 215/DIG. 1; 220/304, 308, 357, 358

[56] References Cited

U.S. PATENT DOCUMENTS 4,276,989 7/1981 Hicks ..... 215/344 X 4,398,645 8/1983 Toeppen ..... 215/344 X 4,442,947 4/1984 Banich, Sr. ..... 215/344

4,450,973 5/1984 Toeppen ..... 215/344 X

*Primary Examiner*—Steven M. Pollard

*Attorney, Agent, or Firm*—Walter C. Farley

[57] ABSTRACT

A screw top has a long, thin annular sealing washer which extends from the ring part of the top to the container opening over its outer edge. During the final phase of screwing down, it is pressed on to the surface around the container opening by a pressure rib attached to the cap part. As the base or root of the washer moves further downwardly, while the contact line between the pressure rib and the packing washer remains fixed, the intermediate portion is expanded. It is therefore pressed against the opening and particularly against the outer edge of the container.

9 Claims, 2 Drawing Figures

RESILIENT MATERIAL SCREW TOP FOR CONTAINERS

This invention relates to a screw top made from an elastic or resilient material for containers, particularly beverage bottles, wherein the screw top is internally threaded for threading onto the container.

BACKGROUND OF THE INVENTION

Numerous different constructions for screw tops of the general type to which this invention relates are known, including screw tops made of resilient material such as plastic. Numerous developments have been made in this field, particularly in connection with screw tops intended for use with containers which are not produced in a careful and precise manner such as beverage bottles. Such bottles tend to suffer from various irregularities such as noncircular tops resulting from imprecise manufacturing techniques as well as indentations, brokenaway parts and the like, depending upon the country of manufacture and the number of movements or cycles between the filling location and the consumer. Tops have been developed for such bottles which can provide a perfect seal despite such irregularities. However, it is necessarily the case that such tops involve considerable technical expenditure and effort and require a relatively large amount of material.

A significant consideration in this field is that numerous very large beverage manufacturers use their own unique, unmistakably recognizable bottles. These bottles are manufactured to a relatively high standard with regard to dimensional accuracy and are substantially free from the aforementioned irregularities because defective bottles are eliminated. In connection with these bottles, it is unnecessarily expensive to use tops which are made to satisfy more demanding circumstances than those which exist. Thus, if it is possible to produce a simpler screw top which has adequately high quality and in which the simplicity leads to a saving of material, such a saving can lead to enormous economies in manufacture and particularly in material cost because of the vast number of such tops which are required, even though the material saving for each individual top seems to be virtually without significance, being in the order of only about 0.1 gram.

BRIEF SUMMARY OF THE INVENTION

Accordingly, an object of the present invention is to provide a very simple, material-saving screw top which is capable of sealing a container in an effective fashion.

Briefly described, the invention comprises a screw top for a container having an opening, a generally annular surface with a circular outer edge surrounding the opening, and a generally cylindrical surface with external threads around the annular surface, the top having a cap portion which extends across the opening and a generally cylindrical ring portion connected to the cap portion and extending axially therefrom. The ring portion has internal threads for engaging the external threads on the container so that the top can be screwed on. The ring portion carries a sealing washer which extends radially inwardly in a position to contact the annular surface of the container when the top is screwed on, the washer being spaced from the inner surface of the cap portion above the threads and lying in a plane parallel with the cap portion when the top is apart from the container, the washer also having a maximum thickness significantly smaller than its radial length. A generally annular, elastically deformable pressure rib is formed on the inner surface of the cap portion and extends toward the washer, the rib being radially positioned between the ring and the inner limit of the washer to permit the washer to be engaged along a circle between the rib and the annular surface before completion of the screwing-on of said top. Thus, as the screwing-on of the top is completed, that portion of the washer between the circle of engagement and the ring portion is elongated, forming a secure seal with the circular edge.

The cap portion, ring portion, washer and rib can be formed from the same elastically deformable or resilient material, and can be integrally formed.

In order that the manner in which the foregoing and other objects are attained in accordance with the invention can be understood in detail, a particularly advantageous embodiment thereof will be described with reference to the accompanying drawings, which form a part of the specification, and wherein FIG. 1 is a partial side elevation of the top of a container and a screw top in accordance with the invention with the screw top partially screwed onto the container; and FIG. 2 is a view similar to FIG. 1 but with the screw top completely screwed onto the container.

DETAILED DESCRIPTION OF THE PREFERRED EMBODIMENT

Figure 1:
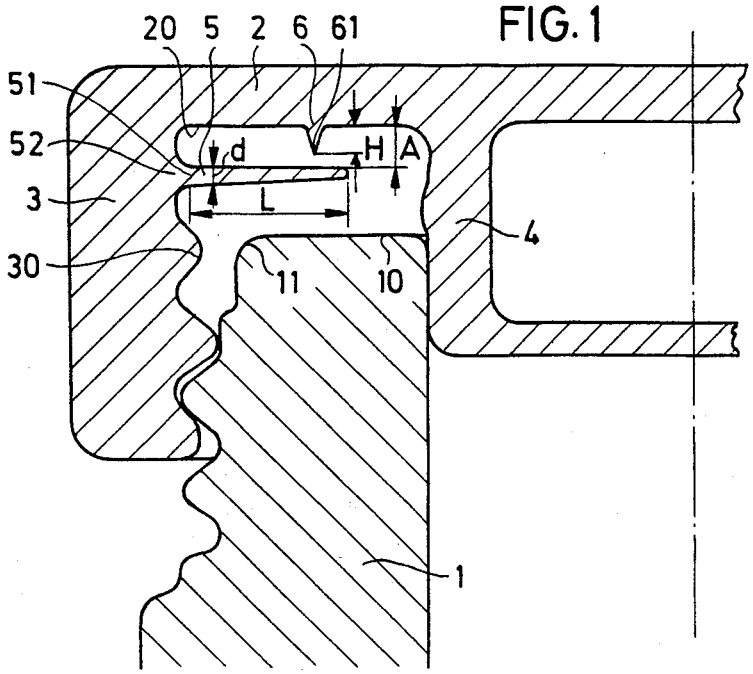

As shown in FIG. 1, the container 1 has a top portion with external threads to receive a screw top and the top in accordance with the invention includes a cap portion 2 which extends generally transversely across the container opening and a cylindrical ring portion 3 which extends axially away from the cap portion and which is fixedly attached thereto, the ring and cap portions normally being integrally formed of the same material. The ring portion is provided with internal threads 30. The cap portion 2 can also have an axially extending portion 4 which enters and engages the mouth of container 1, but which is of no particular significance in connection with the present invention. If provided, portion 4 serves as a first seal between the inside of the container and the opening adjacent annular surface 10 which surrounds the container opening.

The features which are of significance to the present invention include an annular sealing washer 5 which is carried by ring 3 and extends radially inwardly therefrom, the washer having a base or root 51 attached at a location 52 which is above the internal thread 30, i.e., between the thread and the inner surface of cap portion 2, and extends in a plane which is substantially parallel with the inner surface 20 of the cap portion at a distance A thereform, when the screw top is apart from, or only partially screwed onto, the container. As will be seen in the figures, sealing washer 5 is very thin. Its thickness d measured adjacent root 51 is only a fraction of its radial length L, the length being about 5 times the indicated thickness and, preferably, even less. The sealing washer thus also extends parallel with the annular surface 10 surrounding the opening of container 1 and is intended to seal against that surface and, particularly, against the outer circular edge 11 of that surface under pressure. The manner in which this takes place will be described.

A pressure rib 6 is formed on the underside 20 of cap portion 2 and extends axially toward sealing washer 5. Particularly for manufacturing reasons, the axial height H of the rib 6 should be smaller than dimension A as indicated in FIG. 1. Pressure rib 6. is an annular ridge which has a circular end or tip 61 which can be either sharp or slightly rounded.

Figure 2:
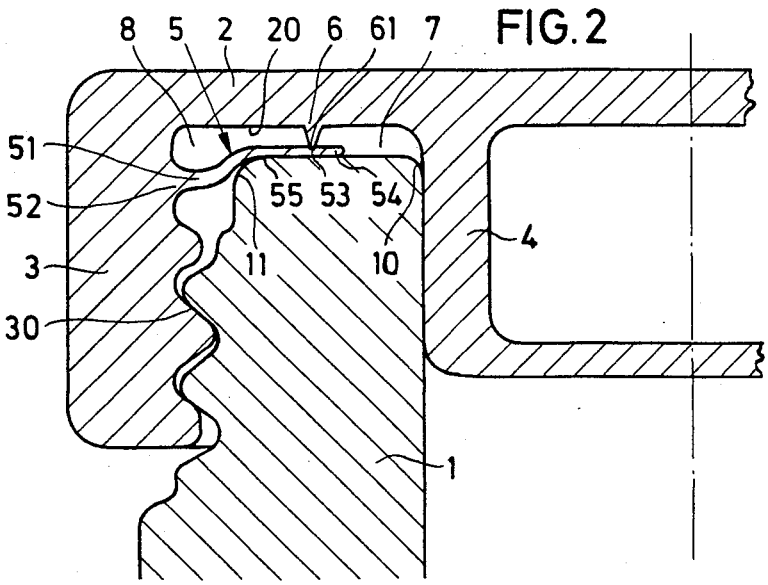

As illustrated in FIG. 2, if the screw top is screwed onto the container, the sealing washer 5 comes in contact with annular surface 10 of the container and rests thereon with its flat surface against flat surface 10. As the top is screwed further on, point 52 and, consequently, root 51 of washer 5 move further downwardly. Whereas in FIG. 1, these portions are located above the plane of surface 10, in FIG. 2 they are below this plane. Thus, during the screwing on process, the sealing washer 5 is caused to lie upon or drape over the outer edge 11 of surface 10. However, the washer cannot continue to follow its downward movement because pressure rib 6, moving with the entire top, also moves downwardly and after a relatively short interval following the contact between washer 5 and surface 10, tip 61 is pressed against the end portion 51 of the sealing washer and presses into the material of the washer, the extent of this deformation being a function of the hardness or elasticity of the material. Thus, the sealing washer 5 is clamped along a circle between pressure rib 6 and a circular region 53 around surface 10. Thus, contact point 53 remains stationary with respect to the sealing washer or, expressed differently, the end portion 54 has a constant length and remains at the same point relative to surface 10. However, portion 55 of the sealing washer which lies between contact circle 53 and base 51 is elastically deformed and elongated because root 52 continues to move downwardly, constantly increasing the distance between line 53 and root 52 across outer edge 11. Although the base or root 51 can yield somewhat and move against the container, this movement is negligibly small compared with the change in length of portion 55 because at point 52 ring portion 3 has much more material than the thin sealing washer.

As will be readily understood from FIG. 2, as a result of the elongation of portion 55, its contact pressure on outer edge 11 constantly increases and a secure seal is formed not only around the edge but also across that portion of surface 10 which lies between clamping circle 53 and edge 11, and to a lesser degree, under portion 54 as well.

Finally, the compression or indentation of rib 6 reaches a value which prevents further screwing on of the top. In automatic bottling machines, the portion of the apparatus, referred to as a bell, which screws down the top is provided with a slip clutch between the drive and the bell, permitting the clutch to slip when this point of contact is reached, terminating the screwing down of the top.

With this arrangement, two annular chambers 7 and 8 are formed on opposite sides of rib 6. In some circumstances, chamber 7 and, possibly, also chamber 8 can fill with gas if the bottle contains a pressure-producing liquid such as mineral water, the temperature of which is elevated after filling. However, any pressure which develops in chamber 8 has an advantageous affect because the pressure therein tends to press washer 5 against edge 11 and downwardly against surface 10.

As will be recognized from the above description, the structure of the invention provides a sealing washer which is subjected to tension in order to accomplish a sealing action. Previously known sealing washers were either subjected to bending as a result of application to the container opening or to pressure through pressing and compressing the free ends at the opening. However, in the present invention, the sealing action is accomplished in a totally new way, namely, by fixing the sealing washer to a point by means of a pressure rib and by a subsequent expansion as a result of tensioning. The tensile stresses occurring in the sealing washer are utilized for the actual sealing action.

A number of materials are useful for manufacturing a cap in accordance with the invention including conventional polymeric materials capable of being formed by known injection molding and other thermosetting molding processes. The material choice is limited only by the requirements that it be usable with the substances to be placed within the container, such as foodstuff, that it be sufficiently rigid when formed as shown and described to hold its shape, and that it be sufficiently elastically deformable to permit elongation of a relatively thin section such as washer 5.

While one advantageous embodiment has been chosen to illustrate the invention, it will be understood by those skilled in the art that various changes and modifications can be made therein without departing from the scope of the invention as defined in the appended claims.

What is claimed is:

1. A screw top for use in combination with a container having an opening, a generally annular end surface with a circular outer edge surrounding and adjacent to the opening and a generally cylindrical surface with external thread means around the cylindrical surface, the top comprising a cap portion;

a generally cylindrical ring portion connected to said cap portion and extending axially therefrom;

internal thread means on said ring portion for threadedly engaging said external thread means to permit screwing on of said top;

a sealing washer extending radially inwardly from said ring portion in a position to contact said annular end surface of said container when said top is screwed thereon, said washer being spaced from the inner surface of said cap portion above said internal thread means and lying in a plane parallel with said cap portion when said top is apart from said container, said washer having a maximum thickness significantly smaller than its radial length; and a generally annular, elastically deformable pressure rib formed on said cap portion and extending axially toward said washer, said rib being positioned radially between said ring portion and the inner limit of said washer to permit said washer to be axially engaged along a circle between the end of said rib and said annular surface before completion of the screwing-on of said top.

whereby the portion of said washer between the circle of engagement and said ring portion is elongated as said screwing-on is completed, forming a secure seal with said circular edge.

2. A screw top according to claim 1, wherein said cap portion, said ring portion, said washer and said rib are formed from an elastically deformable material.

3. A screw top according to claim 2, wherein the radial length of said washer is about five times the axial thickness thereof at its root adjacent said ring portion.

4. A screw top according to claim 2, wherein the radial length of said washer is greater than five times the axial thickness thereof at its root adjacent said ring portion.

5. A screw top according to claim 4, wherein the axial height of said rib is less than the distance between said washer and said cap portion when said top is apart from said container.

6. A screw top according to claim 1, wherein the axial height of said rib is less than the distance between said washer and said cap portion when said top is apart from said container.

7. A screw top according to claim 1, wherein said cap portion, ring portion, rib and washer are unitarily formed from an elastomeric material.

8. A screw top according to claim 1 wherein said annular surface of said container faces generally axially and said cap portion extends transversely across the opening in said container, generally perpendicular to the axis of the container.

9. A screw top according to claim 1 wherein said circle of engagement on said annular surface is spaced inwardly from said outer edge.

* * * * *